US005339647A

United States Patent [19]

Albertson, III et al.

[11] Patent Number: 5,339,647

[45] Date of Patent: Aug. 23, 1994

[54] PORTABLE APPARATUS FOR RECOVERY OF CHLOROFLUOROCARBON (CFC) REFRIGERANTS

[75] Inventors: Luther D. Albertson, III, New Albany; Walter R. Key; Mark A. Stansbury, both of Indianapolis, all of Ind.

[73] Assignee: Redi Controls, Inc., Greenwood, Ind.

[21] Appl. No.: 119,730

[22] Filed: Sep. 10, 1993

[51] Int. Cl.[5] ..... F25B 45/00

[52] U.S. Cl. ..... 62/292; 62/77; 62/335; 165/164; 165/132

[58] Field of Search ..... 62/77, 85, 292, 335; 165/164, 132, 902

[56] References Cited

U.S. PATENT DOCUMENTS

| | | | |
|---|---|---|---|
| 4,476,688 | 10/1984 | Goddard | 62/149 |
| 4,768,347 | 9/1988 | Manz | 62/149 |
| 4,809,520 | 3/1989 | Manz | 62/292 |
| 4,938,031 | 7/1990 | Manz | 62/145 |
| 4,998,413 | 3/1991 | Sato | 62/149 |
| 5,090,211 | 2/1992 | Peters | 62/149 |
| 5,123,259 | 6/1992 | Morgan | 62/292 |
| 5,189,881 | 3/1993 | Miles | 62/77 |
| 5,269,148 | 12/1993 | Ludwig | 62/292 |

*Primary Examiner*—John M. Sollecito

*Attorney, Agent, or Firm*—Woodard, Emhardt, Naughton, Moriarty & McNett

[57] ABSTRACT

A portable apparatus for recovering high-pressure CFC refrigerants in vapor form includes a removable tank for receiving and storing the liquefied refrigerant to be recovered and two refrigeration circuits. The first refrigerant circuit processes the refrigerant to be recovered and includes a compressor and a condenser. The removable tank acts as the evaporator of the first refrigeration circuit. The second refrigeration circuit is included to cool both the condenser of the first refrigeration circuit and the removable tank. This second refrigeration circuit includes a compressor, a condenser and an evaporator, and contains a second refrigerant physically isolated from the refrigerant to be recovered. Both the condenser of the first refrigeration circuit and the evaporator of the second refrigeration circuit are preferably coil shaped, with the condenser coil preferably coaxially arranged within the evaporator coil. The condensing coil/evaporator coil arrangement substantially surrounds the removable tank to assist in cooling that element. The compressor of the first refrigeration circuit is preferably capable of compressing vapor refrigerants to a pressure of at least about 300 psi. Wheels and handles to assist in moving the liquid refrigerant recovery apparatus are also provided.

14 Claims, 2 Drawing Sheets

PORTABLE APPARATUS FOR RECOVERY OF CHLOROFLUOROCARBON (CFC) REFRIGERANTS

FIELD OF THE INVENTION

The present invention relates generally to refrigerant recovery systems, and more particularly to an efficient portable system for recovering high-pressure refrigerants.

BACKGROUND TO THE INVENTION

A number of high-pressure refrigerants are used in various laboratory, commercial and industrial low-temperature refrigeration applications which utilize cascade refrigeration systems and systems which use refrigerants R-503 and R-13 and from time to time need to be recovered and recycled. The majority of these refrigerants are chlorofluorocarbons (CFCs) such as chlorotrifluoromethane, etc. These refrigerants are known to be harmful to the environment, and their release into the atmosphere is restricted or prohibited by law. In addition, these refrigerants have become increasingly expensive, with R-503, for example, costing more than $60.00 per pound.

Occasionally, the refrigerant must be removed from the system in which it is used so that repairs, etc., may be made. The refrigerant must be recovered and shored at such times for the economic and environmental reasons identified above. Due to the significant high pressures of certain CFCs in gaseous form, the recovery of CFC vapor which is then condensed to liquid form is particularly preferred to facilitate efficient recovery and storage.

In tile prior art it is known to pump CFC vapor to a receiving vessel which can be super cooled and pressurized to condense the fluid contained therein. This method requires a significant amount of time to perform with conventional apparatus due to the pressure/temperature combination necessary to recover and contain a given quantity of refrigerant. For example, a pressure of approximately 230 psi is required to condense R-503 at a temperature of 0° F.

It is known to tile prior art to recover the liquid refrigerant in a DOT-approved steel cylinder to facilitate easy transportation when required. Because the recovery is often unplanned, the steel cylinder must be precooled before the recovery process can begin. This may be impractical and may result in complete loss of refrigerant charge. These heavy-walled, steel cylinders are not particularly efficient exchangers of heat, and the use of such cylinders adds significantly to the time required for the refrigerant recovery process.

It is known to the prior art that a number of portable apparatus for recovering high pressure refrigerants exist, however, said apparatus are: (1) not self contained and exist as several distinct parts used together such as a pump or chilling apparatus and containment tank; (2) in cases where chilling the apparatus is not available, remaining parts of the apparatus will only recover between 60 to 70% of a typical charge or require inordinately or excessively huge compressors thereby rendering such procedure impractical.

A number of portable apparatus for recovering refrigerants are known to the art, but all such apparatus are designed to recover refrigerants condensible at temperature/pressure combinations significantly less severe than are required for high-pressure refrigerants. For example, U.S. Pat. No. 4,998,413 to Sato et al. discloses a portable refrigerant recovery system in which the refrigerant to be recovered is cycled through a removable tank to cool the tank as the refrigerant is vaporized therein. The Sato et al. apparatus is not effective for use with high-pressure refrigerants however, as the apparatus includes no compressor to provide the pressures necessary to condense such refrigerants at the temperatures obtained.

U.S. Pat. Nos. 4,938,031 and 4,768,347, both to Manz et al., relate to a portable refrigerant recovery system having a single refrigeration circuit. This system, too, is ineffective for recovering high-pressure refrigerants which must be pressurized and condensed at temperatures far below normal condensing mediums such as water and air.

A need therefore exists for an efficient method of quickly recovering high-pressure refrigerants from low-temperature refrigeration systems, and for a portable apparatus for doing the same. The present invention addresses that need.

SUMMARY OF THE INVENTION

Briefly describing the present invention, there is provided a portable apparatus for recovering high and low pressure refrigerant from refrigerant vapors. The portable apparatus, according to one embodiment of the present invention, comprises a removable tank for receiving and storing the refrigerant be recovered and two refrigeration circuits. The first refrigeration circuit contains the refrigerant to be recovered and includes a compressor and a condenser. The removable tank acts as the evaporator of the first refrigeration circuit. The second refrigeration circuit is included to simultaneously cool the condenser of the first refrigeration circuit and the removable tank. This second refrigeration circuit includes a compressor, a condenser and an evaporator, and contains a second refrigerant physically isolated from the refrigerant to be recovered.

Both the condenser of the first refrigeration circuit and the evaporator of the second refrigeration circuit are preferably coil shaped, with the condenser coil preferably coaxially arranged within the evaporator coil. The condensing coil/evaporator coil arrangement substantially surrounds the removable tank to assist in cooling that element.

The compressor of the first refrigeration circuit is preferably capable of compressing vapor refrigerants to a pressure of at least about 300 psi. Wheels and handles to assist in moving the liquid refrigerant recovery apparatus are also provided.

One object of the present invention is to provide a portable apparatus capable of 100% recovery of high-pressure, CFC refrigerants in vapor form and convertibility to liquid for efficient recovery.

Another object of the present invention is to provide a high-pressure refrigerant recovery apparatus capable of operating preferably but not limited to, 120 VAC current, changing vapor high-pressure refrigerants to liquid for efficient containment.

Another object of the present invention is to provide a portable high-pressure refrigerant recovery apparatus capable of recovering up to about one pound per minute of high-pressure, CFC refrigerant.

Further objects and advantages of the present invention will be apparent from the following description.

DESCRIPTION OF THE PREFERRED EMBODIMENT

Figure 1:
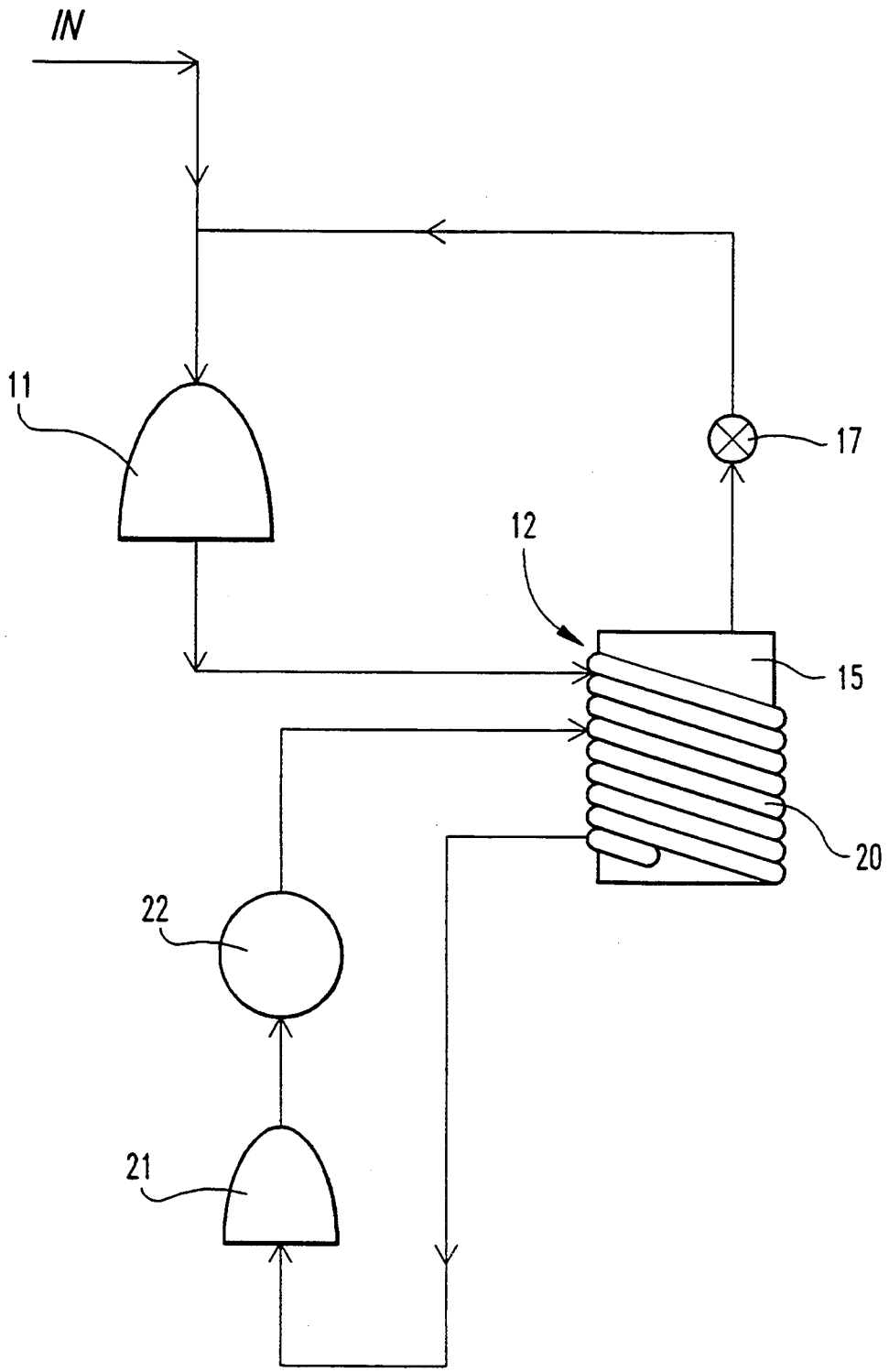
FIG. 1 is a structural diagram of the apparatus of the present invention, according to one preferred embodiment.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to a portable apparatus for recovering high-pressure CFC refrigerant vapors. In one aspect of the invention, a substantial saving of the time required to recover a high-pressure, CFC refrigerant is achieved by alternately liquefying and vaporizing the refrigerant. The refrigerant is liquefied prior to its introduction into a removable tank and is vaporized by the tank and removed from the tank to be returned after recompressing and recondensing as liquid. In another aspect of the invention, a substantial saving in the space occupied by the apparatus is achieved by using one evaporator to simultaneously cool both the condenser of the refrigerant recovery system the removable tank.

The refrigerants which may be recovered by the apparatus of the present invention include all refrigerants. capable of operating in both a liquid and vapor phase at pressures of less than about 230 psi when cooled to a temperature of about 0° F. High-pressure chlorofluorocarbon (CFC) refrigerants are particularly good candidates for the apparatus of the present invention. Examples of such refrigerants are chlorotrifluoromethane (R-13), trifluoromethane (R-23) and azeotropic mixtures thereof, such as R-503. In addition, medium- and low-pressure refrigerants such as dichlorodifluoromethane (R-12) may be effectively recovered with the apparatus of the present invention.

The apparatus of the present invention includes a removable tank for receiving and storing a refrigerant to be recovered, a first condenser to condense that refrigerant, a first compressor capable of compressing the refrigerant vapors to a pressure of up to about 300 psi, and an evaporator containing a second refrigerant. The evaporator is coaxially arranged around the first condenser and is effective to cool both the condenser and the removable tank. Wheels and handles to assist in moving the refrigerant recovery apparatus are also provided.

The removable tanks preferred for use with the apparatus of the present invention are DOT-approved stainless steel recovery cylinders. Most preferred are cylinders having a 20 pound capacity and rated to 2000 psi. These tanks are typically about 29 inches in height, about 7 inches in diameter, and have a tare weight of approximately 30 pounds. As is known in the art, a variety of DOT-approved cylinders are commercially available. Accordingly, the appropriate removable tank for a particular application may be selected by one skilled in the art without undue experimentation.

It is to be appreciated that the apparatus of the present invention includes two complete refrigeration circuits. One circuit contains the refrigerant to be recovered, while the other circuit contains a second refrigerant to assist in condensing the first refrigerant and cooling the removable tank. Accordingly, each refrigeration circuit contains a compressor, a condenser and an evaporator. In the first refrigeration circuit the removable tank, when warm, acts as the evaporator. When the tank is sufficiently cool that the refrigerant to be recovered does not vaporize therein, the refrigeration circuit is interrupted and the refrigerant may be recovered in its condensed form.

Concerning the condenser of the first refrigeration circuit, the preferred condenser is a helically-shaped coil which empties into the removable tank. The first condenser is thermally integral with the evaporator of the second refrigeration circuit, and is preferably coaxial therewith. In addition, the coaxial condenser-/evaporator coil arrangement preferably surrounds the removable tank to assist in cooling the tank to the appropriate temperature. Coaxial condenser/evaporator coil arrangements are known to tile art, and an appropriate condenser for the first refrigeration circuit may be selected by one skilled in the art without undue experimentation.

The compressor of the first refrigeration circuit is any compressor capable of compressing vaporized refrigerants, preferably to a pressure of at least about 300 psi. The high-pressure refrigerants which may be recovered by the apparatus of the present invention require such high pressures in order to condense at temperatures of about 0° F. In order to make the apparatus effective as a portable, stand alone system, the compressors both refrigeration circuits when combined preferably operate 120 volts alternating current. However, it is anticipated that any other electrical configuration should be covered by the process herein. Thus, a standard household or factory electric outlet may be used to power the apparatus of the present invention, making the system easy to use in a variety of settings. Appropriate compressors and refrigeration capacities are known to the art and may be selected without undue experimentation.

A variable pressure regulator is attached to the output of the removable tank so that when the tank is in a warm condition and a condensed liquid refrigerator is introduced, the liquid refrigerant will vaporize through a process known as absorption of the latent heat of vaporization. This vaporization absorbs the sensible heat of the tank thereby cooling it. This process then raises the vapor pressure within the tank which exceeds the optimum operating pressures of the compressor of the first refrigeration circuit. The regulator optimumly allows the vapor to be returned to the input side of the compressor to repeat the cycle over and over until all the sensible heat of the tank has been removed. The result is the tank is being used as an evaporator and gives up its sensible heat, the regulator maintains an efficient compressor pressure to maximize the amount of refrigerant that can be compressed to match condensing capacity of the second refrigeration circuit and provide the means to rapidly cool the tank for maximum efficiency by saving time to allow a recovery process when time is of the essence. It is to be understood that pressure regulating means other than a relief valve may alternatively be used for regulating the pressure inside the removable tank and are intended to be within the scope of the present invention.

The second refrigeration circuit is included to cool the condenser of the first circuit and to maintain the removable tank at a sufficiently low temperature to maintain the condensed refrigerant in its liquid state at system pressure. Accordingly, the second refrigeration circuit includes an evaporator, a condenser and a compressor and is supplied with a second, self-contained refrigerant. The refrigerant of the second refrigeration circuit may be any fluid refrigerant capable of providing the necessary cooling action at system pressures. Refrigerants capable of cooling the contents of the first condensing coil to about O° F. are preferred.

As was noted above, the evaporator of the second refrigeration circuit is thermally integral with the condenser of the first circuit. Preferably, the second evaporator is a helical coil, coaxially arranged around the helical coil of the first condenser. Further, the second evaporator preferably surrounds the removable tank and serves to maintain that tank at a temperature sufficiently low to prevent vaporization and increases in pressure of the refrigerant contained therein.

The condenser and compressor of the second refrigeration circuit are standard components for use in such systems. The second condenser is preferably air cooled, while the compressor preferably operates from a standard household electric current. The components are sized to provide a sufficient amount of condensed second refrigerant to the second evaporator to adequately cool the condenser of the first refrigeration circuit. Suitable components may be selected by one skilled in the art without undue experimentation.

It is to be appreciated that the apparatus of the present invention is a portable apparatus. Accordingly, wheels and handles to assist in moving the apparatus are preferably provided. In addition, the preferred apparatus weighs less than about 280 pounds, and occupies a space of less than about 20 cubic feet. Portable one-piece self contained refrigerant recovery units capable of recovering high-pressure CFC refrigerants are unknown to the prior art.

Figure 2:
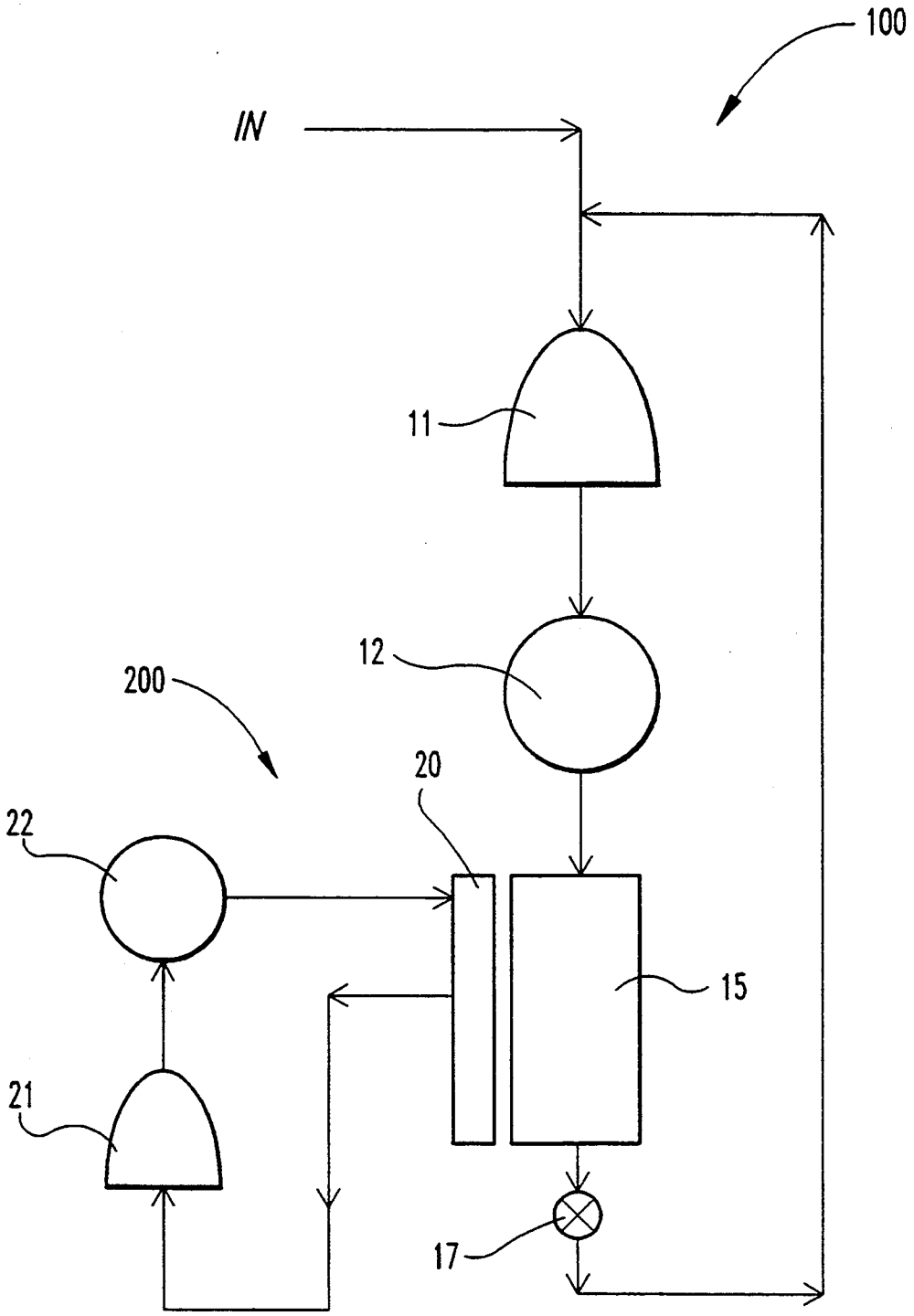
FIG. 2 is a schematic representation of the apparatus of the present invention, according to one preferred embodiment.

In operation, as shown in FIGS. 1 and 2, the refrigerant to be recovered is contained in refrigeration circuit 100. It is initially provided to compressor 11 where the vapors are compressed to a pressure of up to about 230 psi. The compressed vapors are passed to condenser 12 where they are cooled to a temperature sufficient to condense the refrigerant. The condensed refrigerant is emptied into removable tank 15. If the removable tank is not sufficiently cold to maintain the refrigerant in its liquid state, the refrigerant will vaporize and may exit through relief valve 17. The vapors thus released may then be routed back through compressor 11 where they may be recycled through the system.

Second refrigeration circuit 200, including evaporator 20, compressor 21, and condenser 22, is provided to cool both condenser 12 and removable tank 15. A second refrigerant is contained within this second refrigeration circuit, and is physically isolated from the refrigerant to be recovered.

It is the physical arrangement of the evaporator of the second refrigeration circuit and the condenser of the first refrigeration circuit, and the arrangement of that combined evaporator/condenser unit with respect to the removable tank, and vapor return pressure relief providing a means of recondensing that allows the apparatus to function as an efficient and portable unit. As has been noted above, the condenser of the first refrigeration circuit is coaxially arranged with the evaporator of the second refrigeration circuit so that the refrigerant to be recovered may be completely liquefied before it enters the removable tank. Then, by surrounding the removable tank with the evaporator/condenser coil, the evaporator of the second refrigeration circuit also functions to maintain the removable tank at a sufficiently low temperature to prevent the revaporization of the refrigerant contained therein.

It is also to be appreciated that the apparatus of the present invention recovers high-pressure CFC refrigerants at a rate of at least about one-third pound per minute. In addition, the startup time required to chill the recovery cylinder is surprisingly short. As been described above, the removable tank may be quickly chilled by using the tank as the evaporator of the first refrigeration circuit. Accordingly, liquid refrigerant is provided to the removable tank where it absorbs sensible heat from the tank's surface. The sensible heat absorbed by the refrigerant causes latent heat of vaporization. The vapors thereby created are then returned to the compressor of the first refrigeration circuit recompressed, recondensed and returned to the removable tank to repeat the process. The time required to chill the recovery cylinders preferred in the present invention to a temperature of about 0° F. has been measured to be approximately 6 minutes using the method described above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A portable refrigerant recovery apparatus for recovering high-pressure refrigerants in vapor form, comprising:

(a) a first refrigeration circuit, including:

(i) a removable tank for receiving and storing a refrigerant to be recovered, said removable tank functional as the evaporator of said first refrigeration circuit when the tank is sufficiently warm to vaporize liquid refrigerant contained therein;

(ii) a first condenser for condensing the refrigerant to be recovered, wherein said first condenser empties into said removable tank; and (iii) a first compressor to compress vapors of the refrigerant to be recovered, wherein said first compressor has an input and attachment means for coupling to a source of refrigerant to be recovered;

(b) a second refrigeration circuit, including:

(i) a second evaporator, thermally integral with and fluidly isolated from, both the first condenser and the removable tank;

(ii) a second compressor;

(iii) a second condenser;

(c) one or more wheels to assist in moving the liquid refrigerant recovery apparatus; and (d) one or more handles to assist in moving the liquid refrigerant recovery apparatus.

2. The apparatus of claim 1 in which the first refrigeration circuit additionally includes means for regulating the pressure inside said removable tank, said pressure regulating means being located in the first refrigeration circuit between the output of said removable tank and the input of said first compressor.

3. A portable refrigerant recovery apparatus for recovering refrigerant from refrigerant vapor, comprising:

(a) a removable tank for receiving and storing a refrigerant to be recovered, said removable tank capable of acting as the evaporator of said first refrigeration circuit when the tank is sufficiently warm to vaporize liquid refrigerant contained therein;

(b) a first condensing coil for condensing the refrigerant to be recovered, wherein said first condensing coil empties into said removable tank;

(c) a first compressor to compress vapors of the refrigerant to be recovered, wherein said first compressor has an input and attachment means for coupling to a source of refrigerant to be recovered;

(d) means for cooling the refrigerant contained in said first condensing coil, said cooling means comprising:

(i) a second evaporator for a second, self-contained refrigerant, said evaporator being fluidly isolated from and thermally integrated with both said first condensing coil, and said removable tank;

(ii) a second compressor, to compress vapors of the second refrigerant;

(iii) a second condenser to condense vapors of the second refrigerant to a liquid state; and (iv) a condensible refrigerant, physically isolated from the refrigerant to be recovered;

(e) one or more wheels to assist in moving the liquid refrigerant recovery apparatus; and (f) one or more handles to assist in moving the liquid refrigerant recovery apparatus.

4. The apparatus of claim 3 which additionally comprises a relief valve between the output of said removable tank and the input of said first compressor.

5. The apparatus to claim 3 wherein said first condensing coil is helically shaped.

6. The apparatus of claim 5 wherein said helically-shaped coil is coaxial with said second evaporator.

7. The apparatus of claim 3 wherein the apparatus is effective for recovering both high-pressure and low-pressure CFC refrigerants.

8. The apparatus of claim 7, wherein the apparatus is effective for recovering a high-pressure CFC refrigerant selected from the group consisting of: R13, R503, or any gas with similar characteristics such as high pressure low boiling point.

9. The apparatus of claim 8, wherein the apparatus is effective for recovering R-13.

10. The apparatus of claim 8, wherein the apparatus is effective for recovering R-503.

11. The apparatus of claim 10, wherein the apparatus is capable of recovering R-503 at a rate of at least about $\frac{1}{3}$ pounds per minute.

12. The apparatus of claim 3 wherein the first compressor and the second compressor both operate with electric power.

13. The apparatus of claim 12 wherein the first compressor and the second compressor may each be powered from a 120 V electric power outlet.

14. The apparatus of claim 3 wherein the first compressor is capable of compressing refrigerants to a pressure of at least about 300 psi.

* * * * *